United States Patent [19]

Trummer

[11] Patent Number: 4,993,964

[45] Date of Patent: Feb. 19, 1991

[54] ELECTRICAL CONNECTOR ENVIRONMENTAL SEALING PLUG

[75] Inventor: Richard O. Trummer, Littleton, Colo.

[73] Assignee: Martin Marietta Corporation, Bethesda, Md.

[21] Appl. No.: 339,693

[22] Filed: Apr. 18, 1989

[51] Int. Cl.[5] ..... H01R 13/52

[52] U.S. Cl. ..... 439/272; 439/587

[58] Field of Search ..... 439/586, 587, 271–283; 174/65 R, 65 G, 65 SS

[56] References Cited

U.S. PATENT DOCUMENTS

| | | | |
|---|---|---|---|
| 3,970,352 | 7/1976 | Dorrell et al. | 439/595 |
| 4,084,875 | 4/1978 | Yamamoto | 439/274 |
| 4,260,966 | 4/1981 | Boutrors | 439/271 |
| 4,349,241 | 9/1982 | Juris et al. | 439/281 |
| 4,639,061 | 1/1987 | Muzslay | 439/680 |
| 4,697,861 | 10/1987 | Mitchell | 439/449 |

*Primary Examiner*—David Pirlot

*Attorney, Agent, or Firm*—Gay Chin; James G. O'Boyle; Patrick M. Hogan

[57] ABSTRACT

A sealing plug for a multi-contact electrical connector which precludes the necessity for installation of separate end-seal plugs and spare pin contacts to effect the environmental sealing of non-used pin contact cavities in the connector.

5 Claims, 1 Drawing Sheet

ELECTRICAL CONNECTOR ENVIRONMENTAL SEALING PLUG

This invention was made with Government support under Contract No. F04704-84-C-0048 awarded by the Department of the Air Force. The Government has certain rights in this invention.

BACKGROUND OF THE INVENTION

The present invention relates to a sealing plug for a multi-contact electrical connector which precludes the necessity for installation of separate end-seal plugs and spare pin contacts to effect the environmental sealing of non-used contact cavities.

The multi-contact electrical connector to which the sealing plug of the present invention is adapted to be applied is of the type disclosed in U.S. Pat. Nos. 3,970,352 and 4,639,061 wherein the connector includes a plug portion having a shell containing a dielectric plastic insert having pin contact receiving cavities extending therethrough. A relatively soft silicone rubber gasket is mounted in the shell at the forward end of the plug on one side of the plastic insert and provided with apertures aligned with the insert cavities. The gasket is provided with conical projections surrounding the apertures to afford a tight seal with the mating face of the receptacle portion of the connector.

A rear elastomeric grommet is mounted in the shell on the opposite side of the plastic insert and is provided with annular sealing ribs for making a sealing engagement with the insulated wire connected to a pin contact mounted in the insert and extending through the gasket apertures at the front of the plug portion of the connector and extending into a socket contact provided in the mating receptacle portion of the connector.

Heretofore, when sealing a non-used pin contact receiving cavity in the plug portion of the connector, it was customary to insert a spare pin contact into the dielectric insert and through the gasket, and to insert a separate end seal plug into the rear grommet. The spare pin contact was employed to stabilize or maintain the rigidity of the conical projections on the plug gasket to optimize the seal between the mated plug and receptacle portions of the connector. Furthermore, the spare pins provided a field-expedient capability where wiring changes were facilitated with the availability of spare pins for wire termination.

While the above-noted sealing arrangement was satisfactory for its intended purpose, certain disadvantages were experienced, notably, the spare pins became bent during connector usage, and in many instances, spare socket contacts were not installed in the receptacle portion of the connector due to their high cost; thereby eliminating the capability of making wire changes in the field.

After considerable research and experimentation, the sealing plug of the present invention has been devised which is constructed and arranged as a single unit or member to provide the functions of the heretofore employed end seal plug and spare pin contact, and comprises essentially a plastic plug having a length such that it extends through the rear grommet, the dielectric insert and gasket. The forward portion of the sealing plug extends a short distance outwardly from the gasket but not into the socket contact cavity of the mating receptacle portion of the connector, and the rear portion of the plug is engaged by the annular sealing ribs of the grommet, whereby the environmental sealing of the rear grommet and gasket protrusion is provided.

The sealing plug is designed to be installed, retained and extracted in the same manner as a spare pin contact; however, the shank portion of the plug extends outwardly beyond the rear grommet for gripping purposes and to provide a guide for applying an extraction tool when the plug is to be removed.

DESCRIPTION OF THE PREFERRED EMBODIMENT

Figure 1:
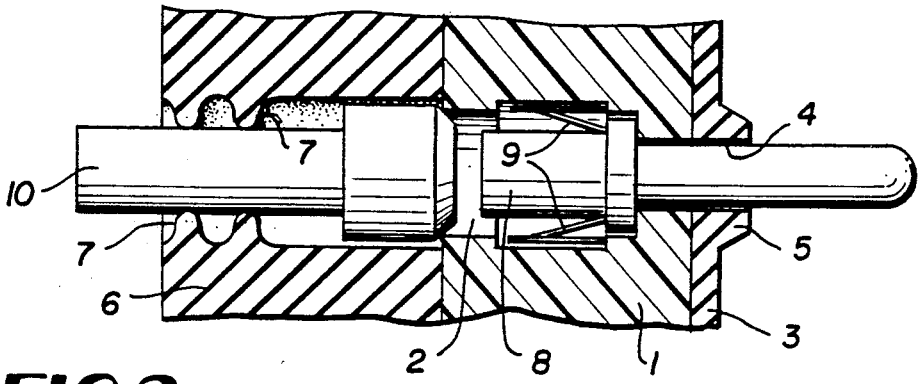
FIG. 1 PRIOR ART
FIG. 1 is a fragmentary, sectional, side elevational view of a plug portion of a connector employing the prior art sealing arrangement for a non-used pin contact receiving cavity.

Referring to the drawing and more particularly to FIG. 1, there is illustrated the prior art arrangement of sealing a non-used pin contact cavity in a conventional multi-contact electrical connector which includes a dielectric plastic insert 1 having a pin contact receiving cavity 2 extending therethrough. A relatively soft silicone rubber gasket 3 is positioned at the forward end of the insert 1 and provided with an aperture 4 aligned with the insert cavity 2. A conical projection 5 surrounds the aperture 4 to afford a tight seal with a mating face on the female portion of the connector, not shown. A rear elastomeric grommet 6 is positioned at the opposite end of the insert 1 and is provided with annular sealing ribs 7 which would make a sealing engagement with an insulated wire extending therethrough when connected to a pin contact mounted in the cavity 2.

The prior art sealing arrangement comprises a spare pin contact 8 mounted in the insert cavity 2 and extending therefrom through the aperture 4 in the gasket 5, the pin contact being retained in the cavity 2 in a conventional manner by spring tines 9. To complete the sealing of the non-used cavity 2, a separate end seal plug 10 is inserted into the grommet 6.

Figure 2:
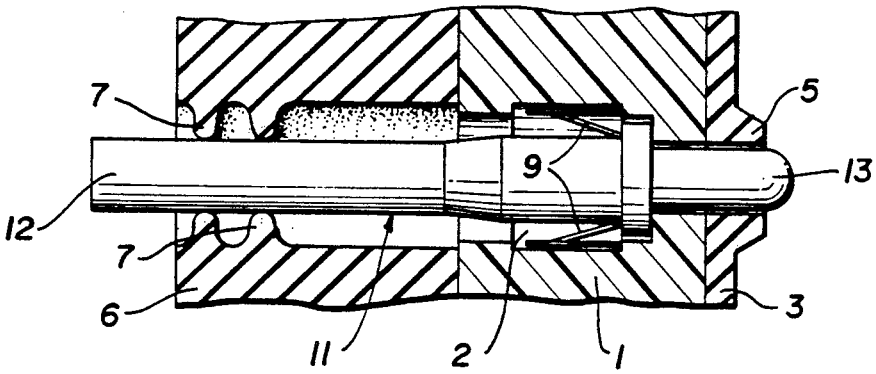
FIG. 2 is a fragmentary, sectional, side elevational view of a plug portion of a connector employing the plug of the present invention for sealing a non-used pin contact receiving cavity.

As will be seen in FIG. 2, the sealing arrangement of the present invention comprises, a plastic plug 11 having the same configuration as the spare pin contact 8 but having a length such that the shank portion 12 extends through the rear grommet 6 and the pin portion 13 extends a short distance outwardly from the gasket 3, the plug 11 being retained in the insert cavity 2 by the spring tines 9.

Figure 3:
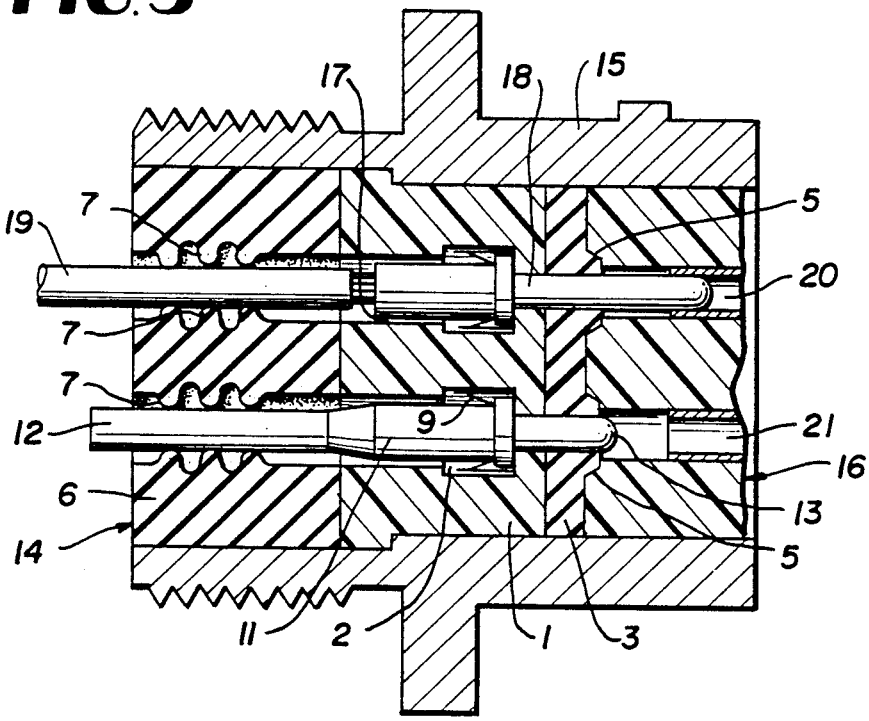
FIG. 3 is a fragmentary, sectional, side elevational view of a connector having mating plug and receptacle portions with the sealing plug of the present invention installed in a non-used pin contact receiving cavity.

FIG. 3 illustrates the multi-contact electrical connector in more detail wherein the plug portion 14 of the connector includes the insert 1, gasket 3 and rear grommet 6 mounted within a housing or shell 15, whereby the plug portion 14 can be coupled to the receptacle portion 16 of the connector.

While the sealing plug 11 of the present invention is shown mounted in the non-used cavity 2 of the insert 1, insert cavity 17 is used for mounting a pin contact 18 connected to an insulated wire 19, the pin contact 18 extending into a contact cavity 20 in the receptacle portion 16 of the connector. Since the pin portion 13 of the sealing plug 11 extends only a short distance outwardly through the gasket 3, it does not extend into corresponding socket cavity 21 of the receptacle portion 16 of the connector.

From the above description, it will be appreciated by those skilled in the art that the sealing plug 11 of the present invention provides an improved environmental sealing assembly for a multi-contact electrical connector wherein a single plug provides the required sealing which heretofore required an end seal plug and a spare pin contact. The rear end seal is provided by the grommet ribs 7 engaging the shank portion 12 of the plug, and the forward end seal is provided by the pin portion 13 maintaining the rigidity of the conical projection 5 on the gasket 3 to optimize the seal between the mated plug portion 14 and receptacle portion 16 of the connector.

The sealing plug 11 is constructed and arranged to be installed, retained and extracted in the same manner as the spare pin contact 8 however, the shank portion 12 of the plug 11 extends outwardly beyond the grommet 6 for gripping purposes and to provide a guide for applying an extraction tool when the plug 11 is to be removed. This provides an improved extraction method over the conventional damage-prone "fishing" method used to locate and engage the heretofore employed spare pin.

The sealing plug of the present invention will result in substantial cost savings for the connector customer by the elimination of costly spare pin contacts, by the elimination of bent spare pins during connector usage and the reduction of connector weight.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An environmental sealing plug for an electrical connector including a connector plug portion having a shell containing a dielectric insert having pin contact receiving cavities, a rubber gasket mounted in the shell at the forward end of the insert, apertures in said gasket aligned with said insert cavities, conical projections provided on said gasket surrounding said apertures, and a rear elastomeric grommet having annular sealing ribs mounted in said shell at the opposite end of said insert, the sealing plug comprising, a dielectric plug mounted in said pin contact receiving cavity, said plug having a shank portion extending through said grommet, and a pin portion extending a short distance outwardly of the gasket through said apertures, to thereby maintain the rigidity of the conical projection on the gasket to optimize the seal between the mated plug portion and a receptacle portion of the connector.

2. An environmental sealing plug according to claim 1, wherein the annular ribs on the grommet engage the shank portion of the sealing plug, to thereby seal the rear plug portion of the connector.

3. An environmental sealing plug according to claim 1, wherein the sealing plug is made of plastic.

4. An environmental sealing plug according to claim 1, wherein the sealing plug has the same configuration as a spare pin contact.

5. An environmental sealing plug according to claim 4, wherein spring tines are mounted in said insert cavity and engage said sealing plug for retaining said plug in said cavity.

* * * * *